US005259756A

United States Patent [19]

Urza

[11] Patent Number: 5,259,756

[45] Date of Patent: Nov. 9, 1993

[54] ROTARY KILN OFF-GAS VENT SYSTEM

[75] Inventor: Inaky J. Urza, Richland, Wash.

[73] Assignee: Siemens Power Corporation, Richland, Wash.

[21] Appl. No.: 904,046

[22] Filed: Jun. 17, 1992

[51] Int. Cl.[5] ..... F27B 7/36

[52] U.S. Cl. ..... 432/103; 432/105; 432/111

[58] Field of Search ..... 432/103, 105, 111

[56] References Cited

U.S. PATENT DOCUMENTS

| | | | |
|---|---|---|---|
| 2,213,667 | 9/1940 | Dundas et al. | 110/14 |
| 2,977,255 | 3/1961 | Lowry | 134/2 |
| 4,052,151 | 10/1977 | Reichrt et al. | 432/115 |
| 4,339,999 | 7/1982 | Fio Rito et al. | 110/226 |
| 4,427,376 | 1/1984 | Etnyre et al. | 432/111 |
| 4,477,984 | 10/1984 | Wenger | 34/128 |
| 4,730,400 | 3/1988 | Johannsen | 34/12 |
| 4,745,869 | 5/1988 | Dilmore et al. | 432/111 |
| 4,765,255 | 8/1988 | Chiarva | 110/226 |
| 4,767,323 | 8/1988 | Dilmore et al. | 432/111 |
| 4,827,854 | 5/1989 | Collette | 110/237 |
| 4,925,389 | 5/1990 | DeCicco et al. | 432/106 |
| 4,952,147 | 8/1990 | Boyden, II et al. | 432/103 |
| 4,955,722 | 9/1990 | Marconnet | 432/118 |
| 4,957,429 | 9/1990 | Mendenhall | 432/111 |
| 5,031,549 | 7/1991 | Collins, Jr. et al. | 110/346 |
| 5,067,254 | 11/1991 | Linkletter et al. | 432/105 |

*Primary Examiner*—Henry C. Yuen
*Attorney, Agent, or Firm*—Ira Lee Zebrak

[57] ABSTRACT

A rotary kiln has a rotatable cylinder through which a product passes in counter-current to a hot gas stream which dries the product. At the product entrance end, a vent annulus enters into the kiln for a length sufficient to allow entrained particles in the exhaust gas to either fall out within the rotating cylinder or pass through the annulus at a velocity sufficient to maintain their entrainment until discharge at a downstream location. Utilizing a vent annulus which enters into the kiln prevents entrained particles from becoming disentrained in the feed breech of the kiln which causes accumulation requiring periodic shut-downs for clean-outs which are disruptive of continuous operation. Utilizing the present invention incorporating a vent annulus in the rotary kiln minimizes down time and increases the efficiency and utilization of the rotary kiln. Additionally, the Separate vent annulus substantially simplifies the feed breech structure of the kiln simplifying construction.

4 Claims, 2 Drawing Sheets

ROTARY KILN OFF-GAS VENT SYSTEM

TECHNICAL FIELD

This invention relates to rotary kilns and more particularly to an off-gas vent system for a rotary kiln which limits product accumulation in the feed breech.

BACKGROUND

A rotary kiln is an apparatus primarily used for drying which consists of a slowly rotating cylinder which is slightly inclined relative to a horizontal plane. The length of the cylinder may range from 4 to more than 10 times its diameter. A wet solid product is fed into the higher end of the cylinder. The solids progress through the cylinder by virtute of the rotation and slope of the cylinder for discharge as a dry or semi dry product at the cylinder lower end. Hot gas flows through the cylinder and interacts with the solids to cause drying. The rate of solids flow may increase or decrease depending on whether the gas flow is co-current or counter-current to the solids flow. Rotary kilns operate at fairly high temperatures and are typically lined with insulating block and/or refractory brick. The means for supplying the hot gas may vary. Some kilns utilize direct firing of a combustible such as natural gas with the combustion products in direct contact with the solid product. If contamination of the product with combustion gases is undesirable, indirect gas or oil fired air heaters may be employed to achieve temperatures in excess of steam temperatures. Of course, gasses other than air may also be used.

The method of feeding the kiln depends upon the solid product characteristics and on the location and type of upstream processing equipment. When the feed comes from above, a chute extending into the cylinder may be employed. For sealing purposes, or if gravity feed is not convenient, a screw feeder is normally used. Typically, auxiliary equipment may be associated with the kiln. For example, the exiting gas may pass through an apparatus for removing entrained dust prior to discharge and/or through apparatus for recovering heat.

When utilizing a counter-current rotary kiln, where gases flow in a direction opposite to the direction in which the product is preceding, it is common for dust or solid particles to become entrained with the gas flow. With such rotary kilns, as the gas is redirected at the kiln feed end, commonly known as the "feed breech", to exit the kiln, the entrained particles strike the kiln wall, become disentrained and accumulate. Such accumulations in the feed breech require periodic kiln shutdowns for clean-out through access holes. Such shutdowns require time for the kiln to cool down, removal of insulation, removal of the accumulated material, etc., which is quite disruptive of continuous operations.

SUMMARY OF THE INVENTION

It is an object of the present invention to provide a rotary kiln utilizing counter-current flow which eliminates particle accumulation in the feed breech.

It is a further object of the present invention to provide an apparatus for preventing the accumulation of solids in the feed breech and thus eliminate the requirement for shut-down and clean-out of the feed breech.

It is another object of the present invention to provide a rotary kiln utilizing counter-current flow which has a simplified construction of the feed breech to reduce product accumulation.

These and other objects of the present invention are achieved by providing a rotary kiln having a rotatable cylinder, a gas inlet end, and a gas outlet end, the gas outlet end being a product feed inlet, and the gas inlet end being the product feed outlet end, the kiln having means for feeding a product therein and outlet means for exhausting a gas at the gas outlet end and further comprising vent means which extend partially into the cylinder, the vent means having one or more openings within the cylinder and being connected to the outlet means such that gas flowing through the kiln exits the kiln by passing through the openings.

Utilizing the present invention, all gas exits the rotary kiln through the vent means rather than through an outlet disposed in the feed breech such that any entrained particles are disentrained within the body of the cylinder or are carried through the tube for removal in downstream processing equipment. Utilizing the vent means prevents material accumulation at the kiln feed entrance thus avoiding periodic clean-out with insulation removal. Additionally, the feed breech for the rotary kiln can be modified to avoid the provision of particle traps and clean-out ports, thus reducing capitol costs.

BRIEF DESCRIPTIONS OF THE DRAWINGS

DETAILED DESCRIPTION OF THE INVENTION

Figure 1:
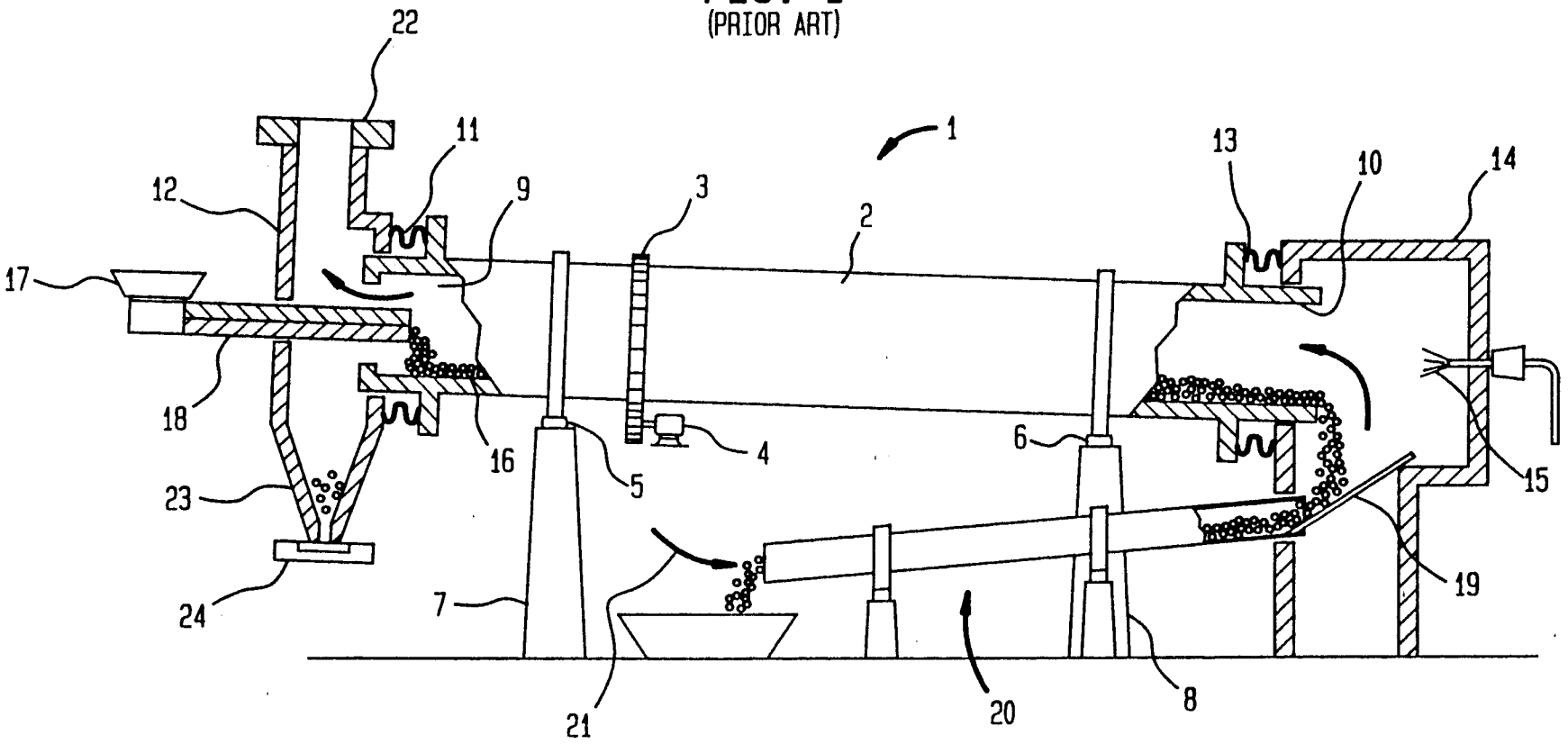
FIG. 1 (PRIOR ART)
FIG. 1 is a prior art rotary kiln having a conventional counter-current product feed section.

Referring to FIG. 1, a prior art rotary kiln is shown. The rotary kiln 1 has a rotatable cylinder 2 actuated through gear 3 by a motor 4 for continuous rotation. The cylinder is rotatably supported on bearings 5 and 6 disposed on supports 7 and 8 with the cylinder at an incline to promote the flow of product through the kiln from a product entrance end 9 to a product exit end 10. The ends 9 and 10 are sealed to stationary structures, with the end 9 being sealed by seal 11 to a feed breech structure 12 and the end 10 sealed by seal 13 to a firing chamber 14 within which direct combustion occurs of a fuel 15 for providing the hot gas which passes through the rotating cylinder. A product 16 enters the kiln through a hopper 17 which has a screw conveyer 18 for depositing the product within the cylinder 2. A discharge chute 19 directs the product exiting the end 10 into a second kiln 20. Air 21 enters the second kiln to flow counter-currently with the product to cool the product prior to discharge. When the air enters the firing chamber 14, it mixes with the fuel 15 and is burned to produce the hot combustion gas which then flows through the cylinder 2. The hot gas exits the cylinder, passing by the conveyer 18, as shown by arrow A, through the feed breech structure, ultimately exiting through a outlet pipe 22.

Figure 2:
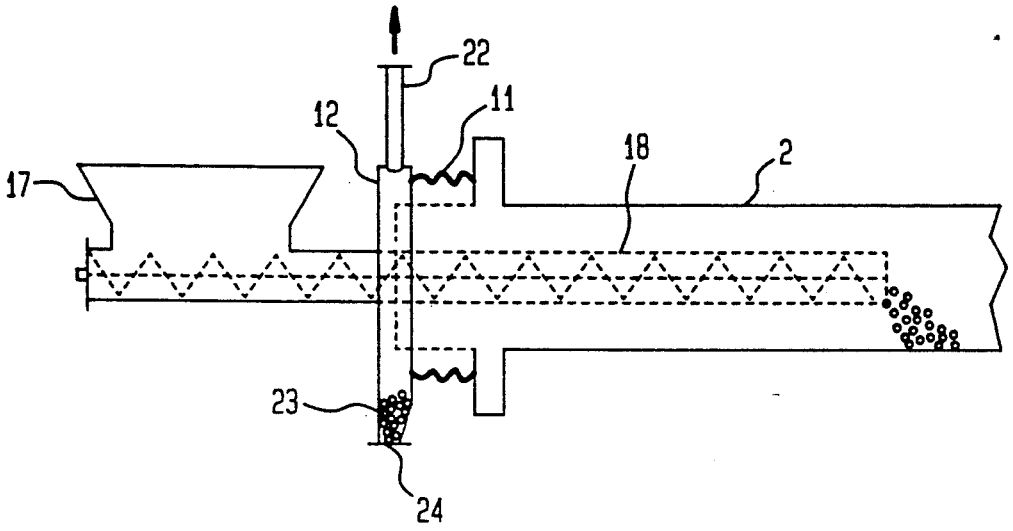
FIG. 2 (PRIOR ART)
FIG. 2 is a enlarged view of the product feed section of the prior art rotary kiln.

FIG. 2 shows an enlarged view of the feed breech structure 12 for the rotary kiln. The feed breech 12 includes a trap section 23 and a clean-out port 24, where entrained particles are captured and accumulated as the gas existing the kiln turns for discharge through the pipe 22. Periodic shut-down and removal of this material is required to prevent upset in the operation of the kiln.

Figure 3:
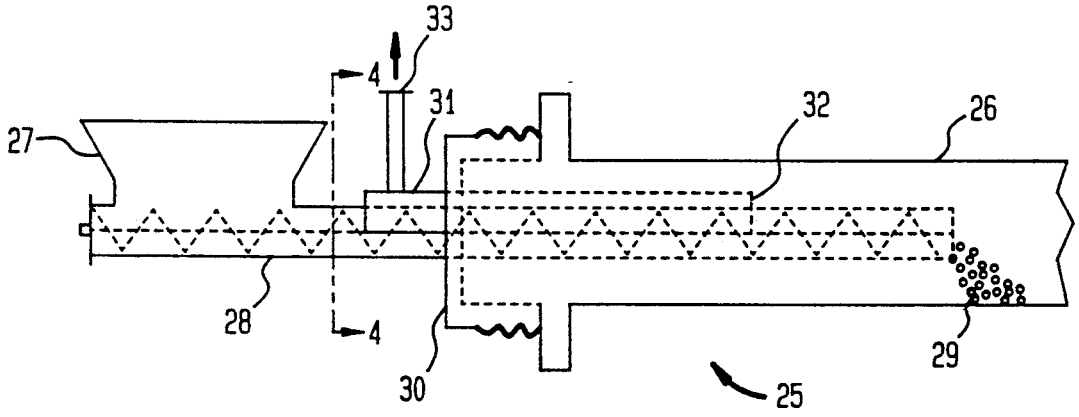
FIG. 3 is a view of the inventive rotary kiln product feed section.

Referring to FIG. 3, the inventive product feed section for a rotary kiln is shown. A kiln 25 has a rotating cylinder 26, a feed hopper 27 and feed conveyer 28 for deposit of a product 29 within the cylinder 26. However, a feed breech structure 30, unlike the structure 12, has no outlet pipe, no trap section and no clean-out port. Instead, a separate vent annulus 31 passes through the structure 30, having a length less than the length of the conveyer preferably being about 25 to 75% on the length of conveyer. The annulus has a first opening 32 within the rotating cylinder and a second opening 33 adjacent the hopper. The first opening has an open area corresponding to the open area of the second opening to maintain a high velocity in the pipe to prevent product accumulation and plugging. The first opening is substantially inward of the end of the rotating cylinder such that the end of the cylinder is essentially dead headed, i.e., there is substantially no gas flow and thus any entrained particles will be deposited in the cylinder not in the feed breech structure. When particles entering the low velocity area, they simply fall to the bottom of the cylinder and are blended with the product as it moves through the cylinder. Consequently, these materials are recovered rather than accumulated. Any particles which enter the first opening 32 are maintained at a high enough velocity such that they remain entrained for separation in a downstream unit such as a dust collector or other apparatus.

Figure 4:
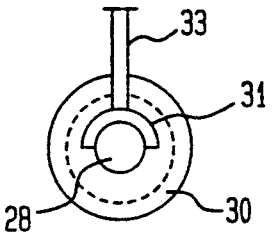
FIG. 4 is a view taken along line 4—4 of FIG. 3.

Referring to FIG. 4, a front view of the kiln end is shown where the annulus 31 has an approximate half pipe shape, partially covering and being supported by the conveyer which enters the rotary kiln. The feed breech structure, without the trap, clean-out port and outlet pipe, is substantially simplified reducing the cost of construction. The elimination of the clean-out port eliminates the need for periodic shut-downs.

While preferred embodiments of the present invention have been shown and described, it will be understood by those skilled in the art that various changes and modifications could be made without varying from the scope of the present invention. For example, while a direct fired rotary kiln is discussed for illustrative purposes, indirect heated kilns would similarly benefit by the present invention. Also, while a half pipe annulus is shown and described, it will be understood that any shaped vent annulus can be used with the present invention.

I claim:

1. A rotary kiln comprising:

an inclined rotating cylinder, a stationary feed breach disposed adjacent a first end of the rotating cylinder, and a stationary exit breach disposed adjacent to a second end of the rotating cylinder, means for conveying a product into the first end of the rotating cylinder, means for discharging the product at the second end of the rotating cylinder, through the exit breach, means for providing a hot gas at the second end of the cylinder, the gas passing through the cylinder in a direction opposite to the direction of movement of the product passing through the cylinder, and vent means located at the first end of the rotating cylinder for removing the hot gas from the kiln, the vent means having a portion disposed adjacent the conveying means and extending into the rotating cylinder for a length sufficient such that entrained particles in the gas stream are disentrained in the rotating cylinder and do not accumulate in the stationary feed breach of the kiln.

2. The rotary kiln of claim 1 wherein the vent means comprise a vent annulus having a first opening within the rotating cylinder and a second opening outside of the first cylinder end.

3. The rotary kiln of claim 2 wherein the vent annulus is about 25–75% of the length of the conveying means.

4. The rotary kiln of claim 2 wherein the first and second openings have approximately the same open area.

* * * * *